US009966714B1

(12) United States Patent
Sreedharan et al.

(10) Patent No.: US 9,966,714 B1
(45) Date of Patent: May 8, 2018

(54) I/O MIGRATION ADAPTER FOR CONTROL SYSTEM

(71) Applicant: Rockwell Automation Asia Pacific Business Ctr. Pte., Ltd., Singapore (SG)

(72) Inventors: Rosh Chathoth Sreedharan, Singapore (SG); Srinivasan Melkote, Singapore (SG); Siva Iyyamperumal, Singapore (SG); Rajiv Chakraborty, Singapore (SG); Soon Seng Kang, Singapore (SG)

(73) Assignee: Rockwell Automation Asia Pacific Business Ctr. Pte., Ltd., Singapore (SG)

( * ) Notice: Subject to any disclaimer, the term of this patent is extended or adjusted under 35 U.S.C. 154(b) by 0 days. days.

(21) Appl. No.: 15/641,614

(22) Filed: Jul. 5, 2017

(51) Int. Cl.

| | |
|---|---|
| ***H01R 25/00*** | (2006.01) |
| ***H01R 25/14*** | (2006.01) |
| ***H01R 31/06*** | (2006.01) |
| ***H01R 13/627*** | (2006.01) |
| ***H01R 43/26*** | (2006.01) |

(52) U.S. Cl.
CPC ..... *H01R 25/142* (2013.01); *H01R 13/6271* (2013.01); *H01R 31/06* (2013.01); *H01R 43/26* (2013.01)

(58) Field of Classification Search
CPC .. H01R 25/14; H01R 25/142; H01R 13/6271; H01R 31/06; H01R 43/26
USPC ..... 439/110, 116, 212, 716
See application file for complete search history.

(56) References Cited

U.S. PATENT DOCUMENTS

| | | | |
|---|---|---|---|
| 5,603,641 | A | 2/1997 | Kuhn |
| 5,904,592 | A | 5/1999 | Baran et al. |
| 6,302,745 | B1 | 10/2001 | Landis et al. |
| 6,418,027 | B1 | 7/2002 | Suzuki et al. |
| 6,431,909 | B1 | 8/2002 | Nolden et al. |
| 7,059,898 | B2 | 6/2006 | Barile |
| 7,892,043 | B1 | 2/2011 | Orand |
| 7,980,891 | B2 | 7/2011 | Molnar |
| 8,066,239 | B2 | 11/2011 | Molnar et al. |
| 8,241,063 | B2 | 8/2012 | Nagata |
| 8,628,004 | B2 | 1/2014 | Vazach et al. |
| 2008/0108248 | A1 | 5/2008 | Lim et al. |
| 2009/0125156 | A1 | 5/2009 | Killian et al. |

(Continued)

FOREIGN PATENT DOCUMENTS

EP 2 421 344 A2 2/2012

OTHER PUBLICATIONS

Beckhoff Fieldbus Components—Documentation for Terminal Modules (KM10X2), Ver. 2.0.0 dated Mar. 21, 2012 (3 pages).

(Continued)

*Primary Examiner* — Khiem Nguyen
(74) *Attorney, Agent, or Firm* — Fay Sharpe LLP

(57) ABSTRACT

A system including a support structure, a plurality of terminal bases mounted to the support structure, a plurality of migration adapters, each migration adapter mounted to a respective terminal base and having first and second adapter connector structures and including first and second backplane connectors for mating with corresponding backplane connectors of one or more adjacent migration adapters mounted to respective adjacent terminal bases for forming a backplane electrically coupling the plurality of migration adapters, and a plurality of I/O modules mounted to the plurality of migration adapters.

15 Claims, 9 Drawing Sheets

(56) References Cited

U.S. PATENT DOCUMENTS

2014/0017917 A1 1/2014 Molnar

OTHER PUBLICATIONS

Beckhoff Fieldus Components—Documentation for Terminal Modules (KM10X4 / KM10X8), Ver. 2.0.0 dated Mar. 21, 2012 (3 pages).
X20 System User's Manual (B & R), Ver. 3.00 dated Oct. 2014, pp. 62, 2326-2328.

I/O MIGRATION ADAPTER FOR CONTROL SYSTEM

BACKGROUND

The present exemplary embodiment relates to the field of automation control systems, such as those used in industrial and commercial settings. It finds particular application in conjunction with providing, accessing, configuring, operating, or interfacing with input/output (I/O) devices that are configured for coupling and interaction with an automation controller, and will be described with particular reference thereto. However, it is to be appreciated that the present exemplary embodiment is also amenable to other like applications.

Automation controllers are special purpose computers used for controlling industrial automation and the like. Under the direction of stored programs, a processor of the automation controller examines a series of inputs (e.g., electrical input signals to the automation controller) reflecting the status of a controlled process and changes outputs (e.g., electrical output signals from the automation controller) based on analysis and logic for affecting control of the controlled process. The stored control programs may be continuously executed in a series of execution cycles, executed periodically, or executed based on events. The inputs received by the automation controller from the controlled process and the outputs transmitted by the automation controller to the controlled process are normally passed through one or more I/O devices, which are components of an automation control system that serve as an electrical interface between the automation controller and the controlled process.

Traditional I/O devices typically include a base configured to couple the I/O device with a bus bar or the like, a terminal block for communicatively coupling the I/O device with field devices, and an I/O module that includes circuitry for performing communication functions and/or logic operations.

BRIEF DESCRIPTION

In accordance with one aspect, an I/O system comprises a support structure, a plurality of terminal bases mounted to the support structure, each terminal base including a terminal block for electrically coupling the terminal base to an associated field device, first and second backplane connectors for mating with corresponding backplane connectors of one or more adjacent terminal bases mounted on the support structure for forming a first backplane electrically coupling the plurality of terminal bases, and a receptacle having a first connector structure electrically coupled to the terminal block and the first and second backplane connectors, a plurality of migration adapters, each migration adapter mounted to a respective terminal base and having first and second adapter connector structures, the first adapter connector structure configured for electrically and mechanically coupling the migration adapter with the first connector structure of the terminal base, each migration adapter further including first and second backplane connectors for mating with corresponding backplane connectors of one or more adjacent migration adapters mounted to respective adjacent terminal bases for forming a second backplane electrically coupling the plurality of migration adapters, and a plurality of I/O modules mounted to the plurality of migration adapters, each I/O module having an I/O module connector structure for electrically and mechanically coupling the I/O module to the second adapter connector structure of the migration adapter to which it is mounted. Each of the I/O modules are electrically coupled to a respective associated field device via the respective migration adapter to which it is mounted and the terminal block of the terminal base to which the migration adapter is mounted, and electrically coupled to the second backplane.

The first and second backplane connectors of each of the plurality of migration adapters can include a female backplane connector and a male backplane connector, wherein a female backplane connector of a first migration adapter is configured to slidingly receive a male backplane connector of an adjacent second migration adapter. The female backplane connector can include a pair of spaced apart slots adapted to receive respective flanges of a male backplane connector. The flanges can be L-shape in cross-section and interlock with surfaces of the slots to restrict separation of adjacent migration adapters. The second backplane can be spaced apart from the first backplane. In an embodiment, the second backplane is spaced further from the support structure than the first backplane. The support can include a DIN rail. The migration adapter can include at least one keyed mechanical structure for mating with a corresponding keyed mechanical structure of the I/O module.

In accordance with another aspect, a migration adapter for adapting a first generation I/O system having a terminal base with a first connector structure for coupling with a first generation I/O module to a second generation I/O system including a second generation I/O module, the migration adapter comprises a body having a first adapter connector structure, the first adapter connector structure configured for mechanically coupling the migration adapter with the first connector structure of an associated terminal base and electrically coupling the migration adapter to a terminal block of the associated terminal base, the migration adapter further including first and second backplane connectors for respectively mating with corresponding second and first backplane connectors of one or more adjacent associated migration adapters for forming a backplane electrically coupling the plurality of migration adapters, and a second adapter connector structure configured for mechanically and electrically coupling the migration adapter to an associated second generation I/O module such that the associated second generation I/O module is electrically coupled to the terminal block of the associated terminal base via the migration adapter and electrically coupled to the backplane formed by the plurality of migration adapters, whereby the associated second I/O module is electrically coupled to a field device connected to the associated terminal base.

In accordance with another aspect, a method comprises removing a first generation I/O module from an existing I/O system installation, the existing I/O system installation having at least one terminal base mounted to a support, the at least one terminal base having a terminal block for coupling the terminal base with at least one field device, installing a migration adapter to the terminal base in place of the first generation I/O module, the migration module including a body having a first adapter connector structure configured for mechanically coupling the migration adapter with the terminal base and electrically coupling the migration adapter to the terminal block of the associated terminal base, the migration adapter further including first and second backplane connectors for mating with corresponding backplane connectors of one or more adjacent associated migration adapters for forming a backplane electrically coupling the plurality of migration adapters, and a second adapter connector structure configured for mechanically and electrically coupling the migration adapter to a second generation I/O module, installing a second generation I/O module to the migration adapter such that the second generation I/O module is electrically coupled to the terminal block of the associated terminal base via the migration adapter and electrically coupled to the backplane.

DETAILED DESCRIPTION

Figure 1:
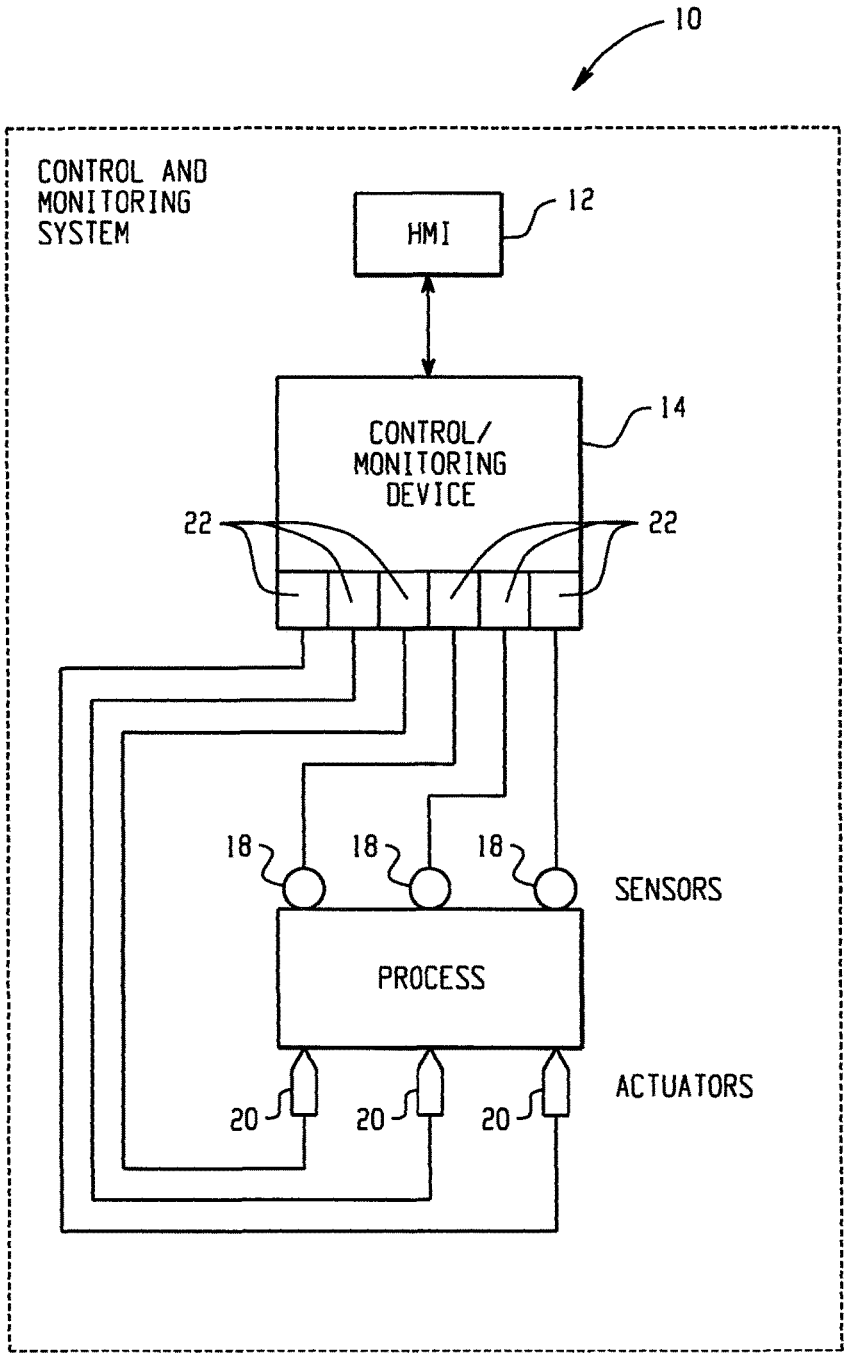
FIG. 1 is a schematic diagram of an exemplary control and monitoring system.

With reference to FIG. 1, a diagrammatical representation is shown of an exemplary control and monitoring system adapted to interface with networked components and configuration equipment in accordance with embodiments of the present techniques. The control and monitoring system is generally indicated by reference numeral 10. Specifically, the control and monitoring system 10 is illustrated as including a human machine interface (HMI) 12 and an automation controller or control/monitoring device 14 adapted to interface with components of a process 16. It should be noted that such an interface in accordance with embodiments of the present techniques may be facilitated by the use of certain network strategies. Indeed, an industry standard network may be employed, such as DeviceNet, to enable data transfer. Such networks permit the exchange of data in accordance with a predefined protocol, and may provide power for operation of networked elements.

The process 16 may take many forms and include devices for accomplishing many different and varied purposes. For example, the process 16 may comprise a compressor station, an oil refinery, a batch operation for making food items, a mechanized assembly line, and so forth. Accordingly, the process 16 may comprise a variety of operational components, such as electric motors, valves, actuators, temperature elements, pressure sensors, or a myriad of manufacturing, processing, material handling, and other applications. Further, the process 16 may comprise control and monitoring equipment for regulating process variables through automation and/or observation.

For example, the illustrated process 16 comprises sensors 18 and actuators 20. The sensors 18 may comprise any number of devices adapted to provide information regarding process conditions. The actuators 20 may include any number of devices adapted to perform a mechanical action in response to a signal from a controller (e.g., an automation controller). The sensors 18 and actuators 20 may be utilized to operate process equipment. Indeed, they may be utilized within process loops that are monitored and controlled by the control/monitoring device 14 and/or the HMI 12. Such a process loop may be activated based on process inputs (e.g., input from a sensor 18) or direct operator input received through the HMI 12.

As illustrated, the sensors 18 and actuators 20 are in communication with the control/monitoring device 14 and may be assigned a particular address in the control/monitoring device 14 that is accessible by the HMI 12. The sensors 18 and actuators 20 may communicate with the control/monitoring device 14 via one or more I/O devices 22 coupled to the control/monitoring device 14. The I/O devices 22 may transfer input and output signals between the control/monitoring device 14 and the controlled process 16. The I/O devices 22 may be integrated with the control/monitoring device 14, or may be added or removed via expansion slots, bays or other suitable mechanisms. For example, as described in greater detail below, additional I/O devices 22 may be added to add functionality to the control/monitoring device 14. Indeed, if new sensors 18 or actuators 20 are added to control the process 16, additional I/O devices 22 may be added to accommodate and incorporate the new features functionally with the control/monitoring device 14. The addition of I/O devices 22 may include disassembly of components of the I/O devices 22. It should be noted that the I/O devices 22 serve as an electrical interface to the control/monitoring device 14 and may be located proximate or remote from the control/monitoring device 14, including remote network interfaces to associated systems.

The I/O devices 22 may include input modules that receive signals from input devices such as photo-sensors and proximity switches, output modules that use output signals to energize relays or to start motors, and bidirectional I/O modules, such as motion control modules which can direct motion devices and receive position or speed feedback. In some embodiments, the I/O devices 22 may convert between AC and DC analog signals used by devices on a controlled machine or process and DC logic signals used by the control/monitoring device 14. Additionally, some of the I/O devices 22 may provide digital signals to digital I/O devices and receive digital signals from digital I/O devices. Further, in some embodiments, the I/O devices 22 that are used to control machine devices or process control devices may include local microcomputing capability on an I/O module of the I/O devices 22.

In some embodiments, the I/O devices 22 may be located in close proximity to a portion of the control equipment, and away from the remainder of the control/monitoring device 14. In such embodiments, data may be communicated with remote modules over a common communication link, or network, wherein modules on the network communicate via a standard communications protocol. Many industrial controllers can communicate via network technologies such as Ethernet (e.g., IEEE802.3, TCP/IP, UDP, EtherNet/IP, and so forth), ControlNet, DeviceNet or other network protocols (Foundation Fieldbus (H1 and Fast Ethernet) Modbus TCP, Profibus) and also communicate to higher level computing systems.

Figure 2:
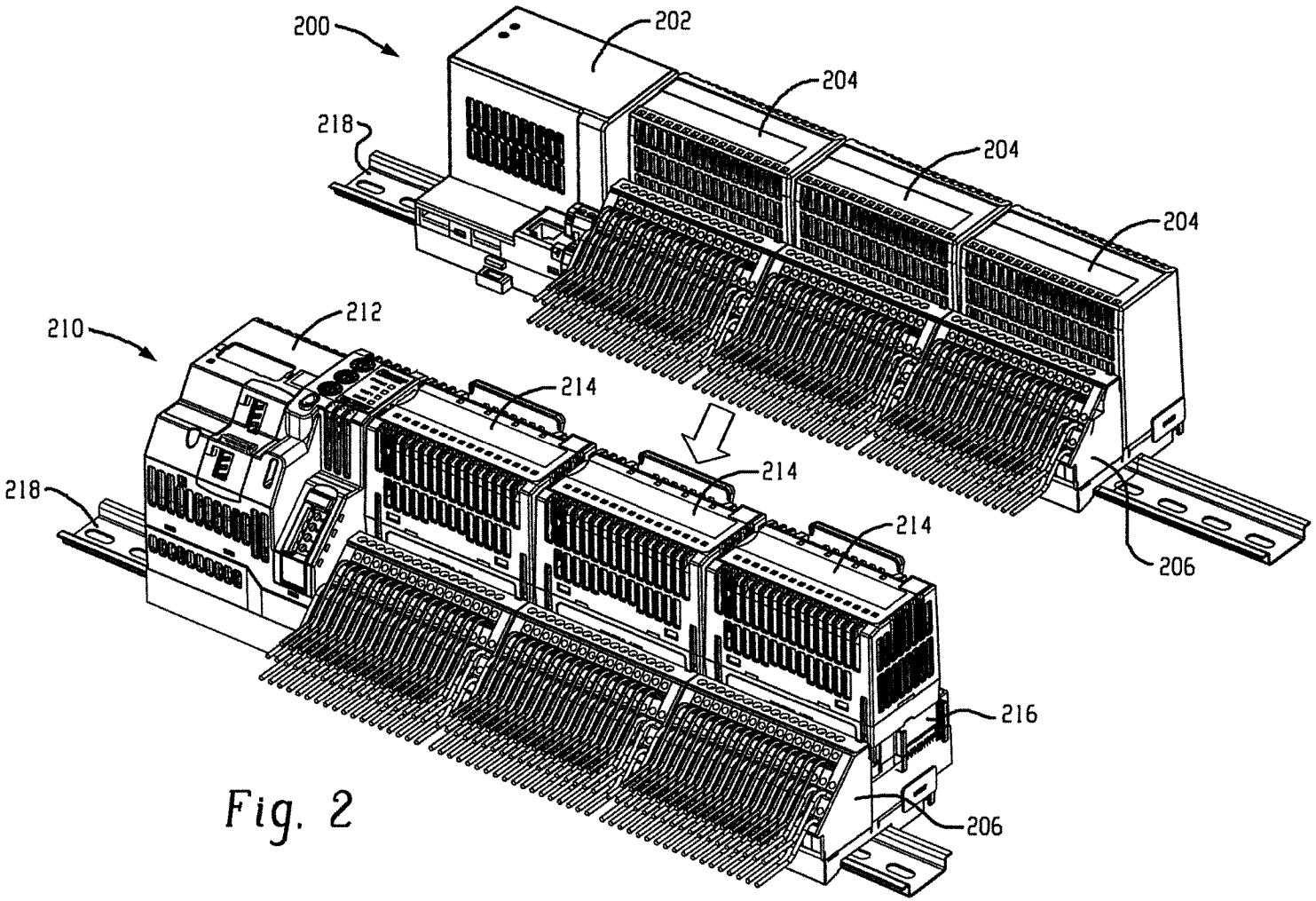
FIG. 2 is a perspective view of a migration from a first generation I/O system to a second generation I/O system in accordance with the present disclosure.

Turning to FIG. 2 an exemplary I/O system conversion is illustrated. As shown, a first generation I/O system 200 including a communication module 202 and a plurality of first generation I/O modules 204 mounted to respective terminal bases 206 is converted to a second generation I/O system 210 having a communication module 212 and a plurality of second generation I/O modules 214. The second generation I/O modules 214 are mechanically and electrically coupled to the existing terminal bases 206 and to each other and/or the communication module 212 through a migration adapter 216. It should be appreciated that the terminal bases 206 are supported by a support structure, such as DIN rail 218, and that neither the terminal bases 206 or wired connections thereto need to be removed when performing the conversion from the first generation I/O system 200 to the second generation I/O system 210. It should further be appreciated that while the components of the second generation I/O system 210 are mountable directly to a DIN rail (in conjunction with new terminal bases) for new installations, the aspects of the present disclosure are directed to upgrading existing installations with the second generation components without having to perform all of the labor of a new installation.

Figure 3:
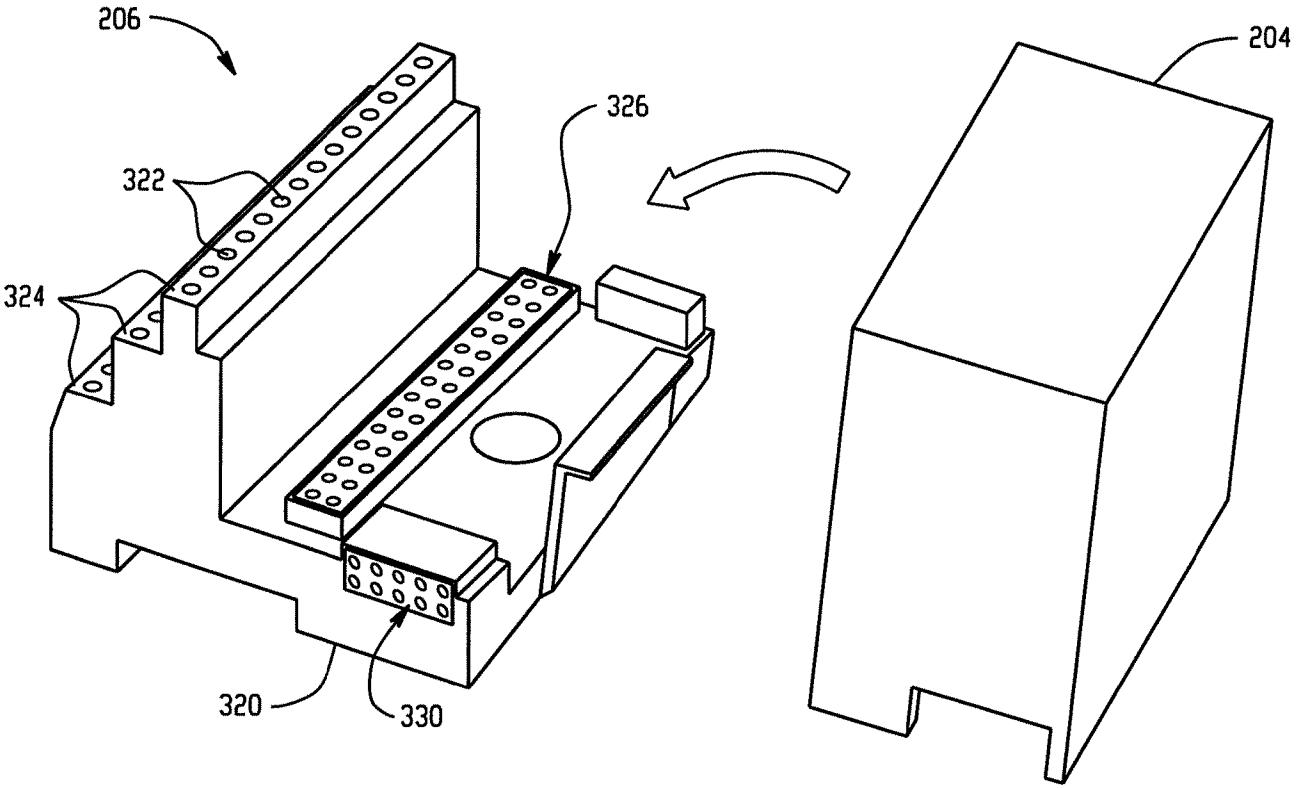
FIG. 3 is a perspective view of an exemplary first generation terminal base and I/O/module.

Turning to FIG. 3, a simplified perspective view of an exemplary first generation I/O module 204 and terminal base 206 is shown. Although FIG. 3 illustrates a first generation I/O module 204, many of the following details are equally applicable to a second generation I/O module 214 when mounted to terminal base 206 with a migration adapter 216, as will become apparent below. The terminal base 206 serves to mechanically mount the I/O module 204 on a support structure, such as DIN rail 218. Various mechanisms can be used for permanently or releasably securing the terminal base 206 to the DIN rail. Terminals 322 are provided for terminating conductors, such as data and power conductors used to transmit signals to and from the I/O modules and/or other components. The terminals 322 which, in certain embodiments, may be removable from the terminal base 206, can be provided in tiers 324 to facilitate the use of a substantial number of terminations. The illustrated terminal base 206 includes an interface 326 for electrically coupling with an I/O module 204. The interface 326 includes connections for the various power and signal lines needed for the I/O module 204, with the I/O module 204 including a mating electrical interface along a bottom side thereof. The I/O module 204 thus simply plugs into the terminal base 206 for completion of all necessary connections. For interfacing the various monitoring, relay, and other I/O modules 204 of a group or assembly, then, a terminal base interface 330 is provided. In the illustrative example of FIG. 3, the interface 330 is extendable and retractable from the side surface of the terminal base 206, and, when extended, plugs into a conforming receptacle within an opposite side of a similar terminal base 206 defining a first backplane for transmitting power and data signals between a number of terminal bases and/or a communication module. Necessary connections for data exchange in accordance with the open industrial data exchange protocol are then provided between the I/O modules 204 via the respective terminal bases 206.

Each I/O module generally includes I/O control circuitry and/or logic. In general, the I/O modules receives input signals from the field devices via terminals 322, delivers output signals to the field devices via terminals 322, performs general and/or specific local functionality on the inputs and/or outputs, communicates the inputs and/or outputs to the control/monitoring device 14 and/or other I/O devices, and so forth.

Figure 8:
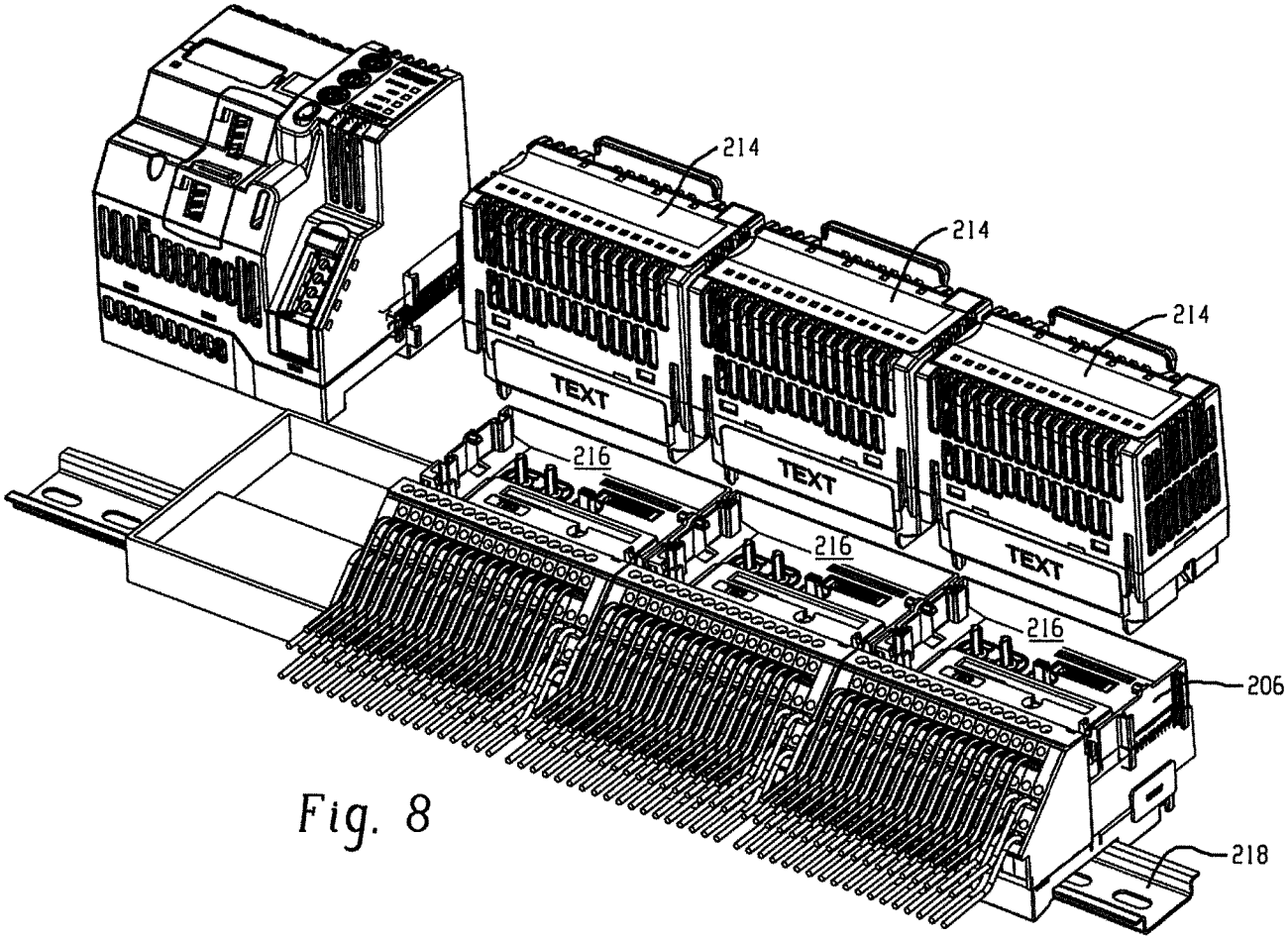
FIG. 8 is a perspective view of the installation of the second generation I/O modules and communication module.
Figure 9:
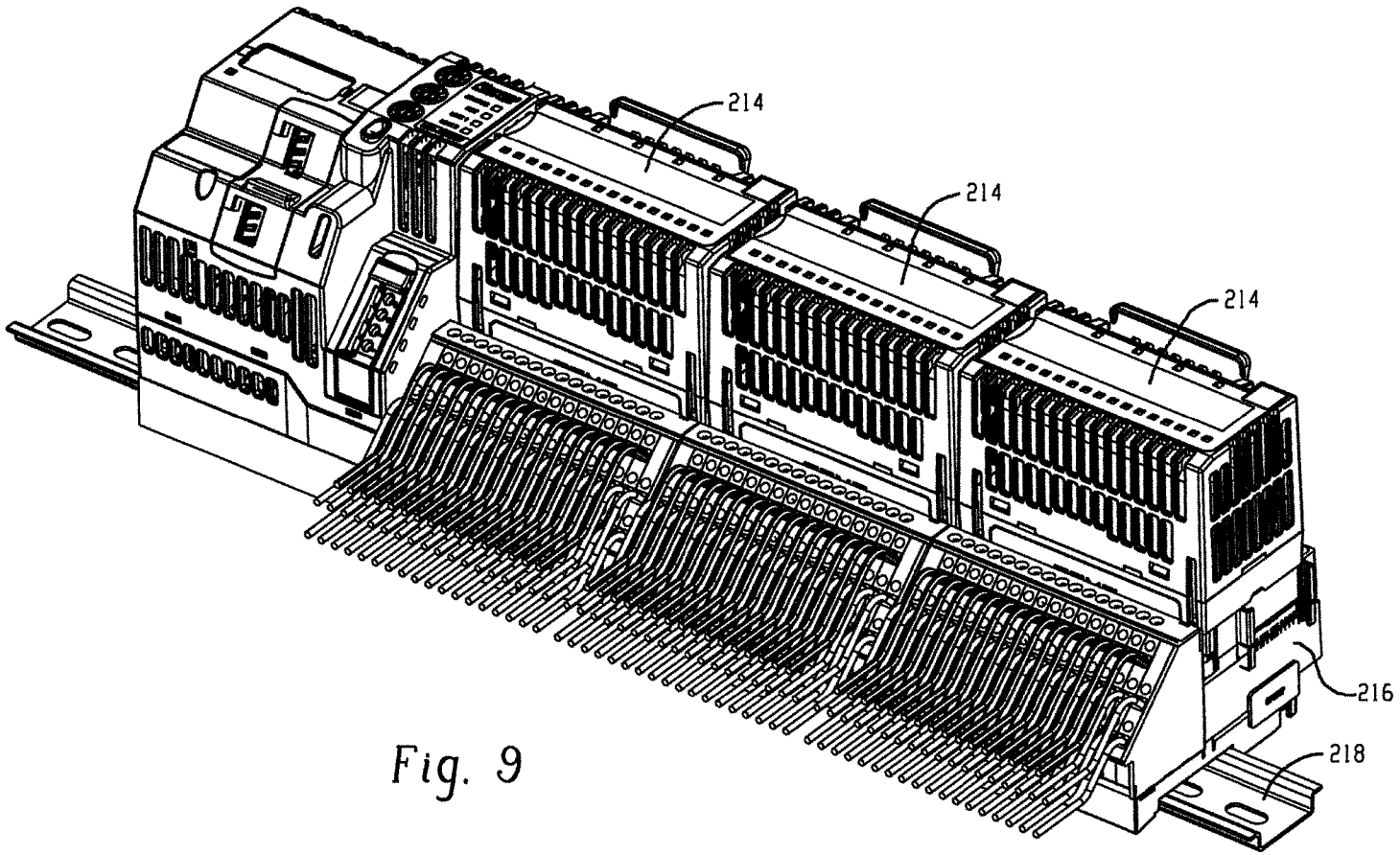
FIG. 9 is a perspective view of the completed migration to the second generation I/O system.

It should be appreciated that different I/O modules 204 may be inserted into the terminal base 206 to provide different levels of I/O functionality. For example, certain I/O modules 204 may provide general functionality, such as receiving signals from the field device to which the I/O module is connected, transmitting the received signals to an automation controller (e.g., the control/monitoring device 14 of FIG. 1), receiving control signals from the automation controller, and transmitting the control signals to the field device. However, other I/O modules 204 may provide more specific functionality, such as performing specific operations on the signals that are received from the field device, the automation controller, and so forth. For example, certain I/O modules 204 may include specific software for performing specific operations relating to particular types of equipment, particular industry applications, particular local control functions (e.g., performed within the I/O module 204), and so forth. Therefore, although the terminal base 206 of adjacent I/O devices may remain attached to each other and/or the DIN rail 212 during operation of the I/O modules, the I/O modules 204 may often be removed and re-inserted for diagnostics and troubleshooting of one or more components, and/or for changing the functionality of one or more of the devices. Indeed, this is an advantageous aspect of the modular nature of the terminal blocks 206 and the I/O modules 204 and/or 214 of the I/O systems of FIG. 2. Additional details of I/O devices and systems can be found in U.S. Pat. No. 7,593,784 and U.S. Pat. No. 8,628,004, which are each hereby incorporated herein by reference in their entireties Turning to FIGS. 4-9, and in accordance with the present disclosure, the first generation I/O system 200 is transformed into the second generation I/O system 210 through three basic steps: removal of existing I/O modules 204 from terminal bases 206 (FIG. 4), installation of I/O migration adapters 216 onto the terminal bases 206 (FIGS. 5 and 6) to adapt the existing terminal base interface 326 to the second generation I/O module interface 508 and provide first and second, second generation backplane connectors 730/740, and installation of I/O modules 214 onto the I/O migration adapters 504 (FIGS. 8 and 9). In some embodiments, the first generation communication module 202 remains functional and forms a part of the second generation I/O system 210. In other embodiments, a new communication module, such as communication module 212, can be installed. Significantly, none of terminal bases 206 or the connections to/from the field devices to the terminals 322 of respective terminal bases 206 require disconnection/reconnection, changing or other reconfiguration to effect the transformation from the first generation I/O system 200 to the second generation I/O system 210. Accordingly, the present disclosure sets forth methods and structure for upgrading existing I/O systems with current technology that requires little system downtime and utilizes many of the same components and configurations of existing I/O system installations.

Figure 4:
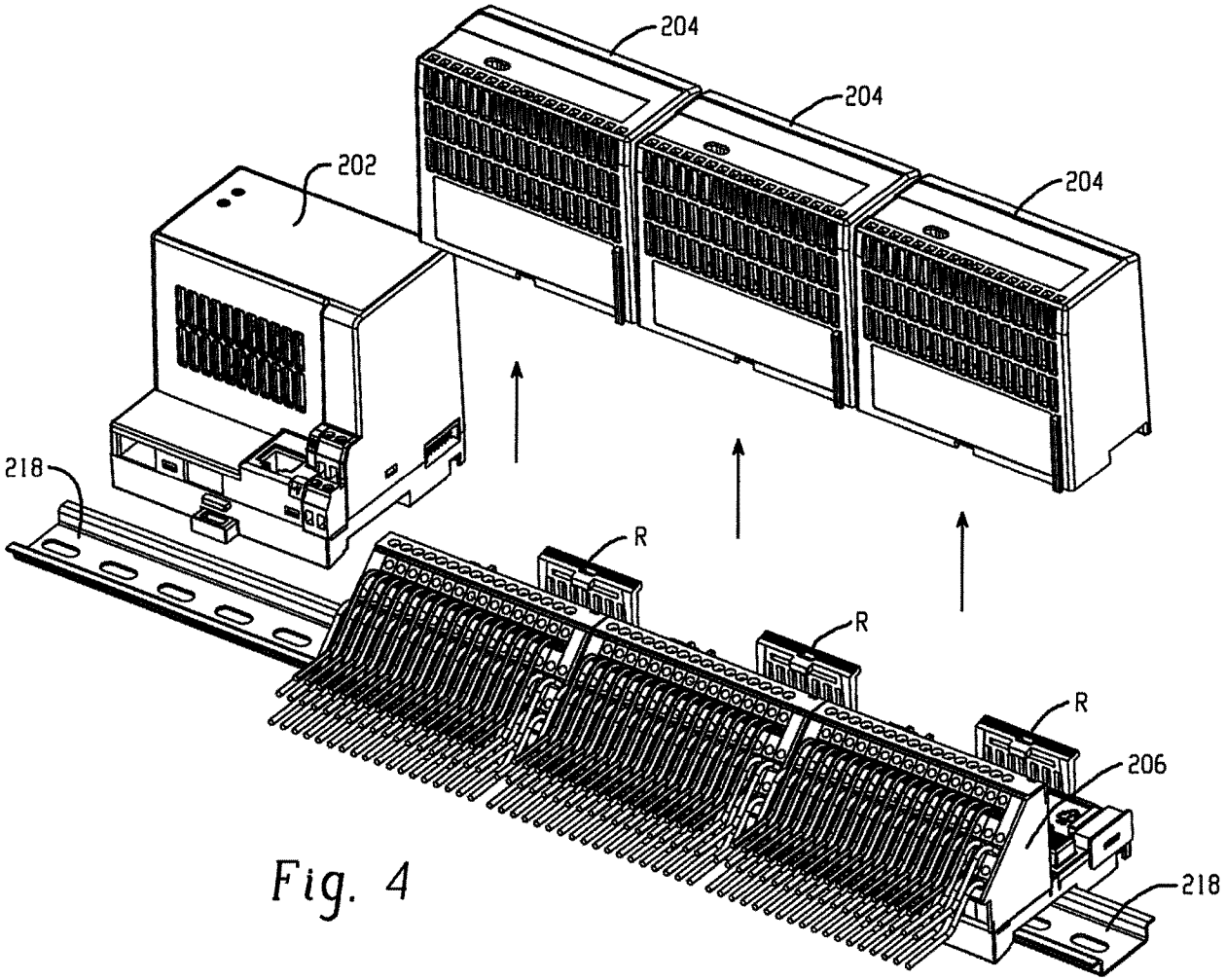
FIG. 4 is a perspective view of the removal of the first generation I/O modules and communication module.

In FIG. 4, the communication module 202 is shown detached from the DIN rail 218 and the I/O modules 204 are shown detached from their respective terminal bases 206. It will be appreciated that removal of the components can general include manipulating a release/retainer mechanism R of each terminal base 206 (or other device configured to retain the components on terminal bases 206). As noted, the terminal bases 206 remain secured the DIN rail 218, and the connections to/from the field devices to the terminals 322 of respective terminal bases 206 remain unchanged.

Figure 5:
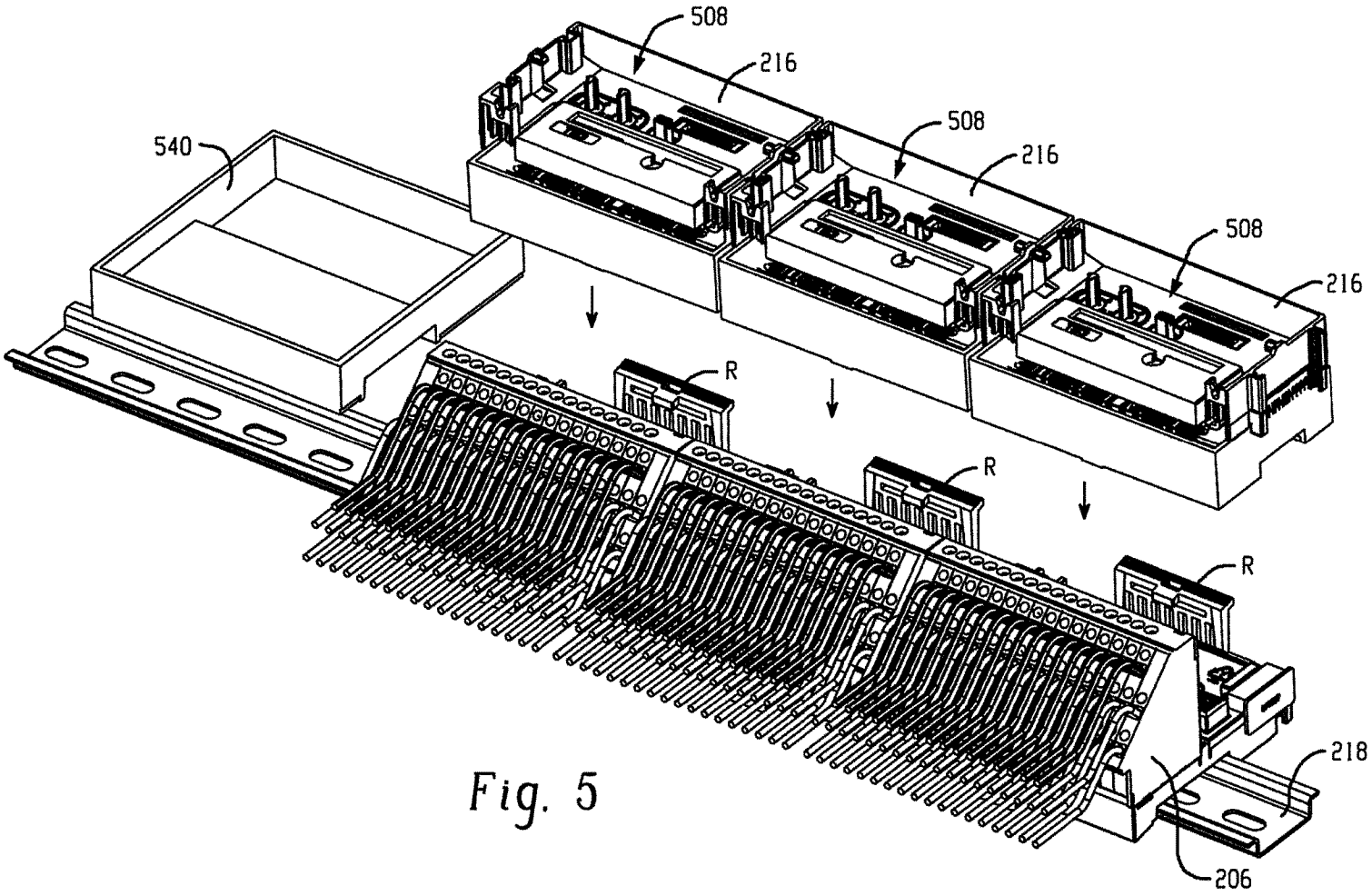
FIG. 5 is a perspective view of the installation of migration adaptors onto the existing first generation terminal blocks.
Figure 6:
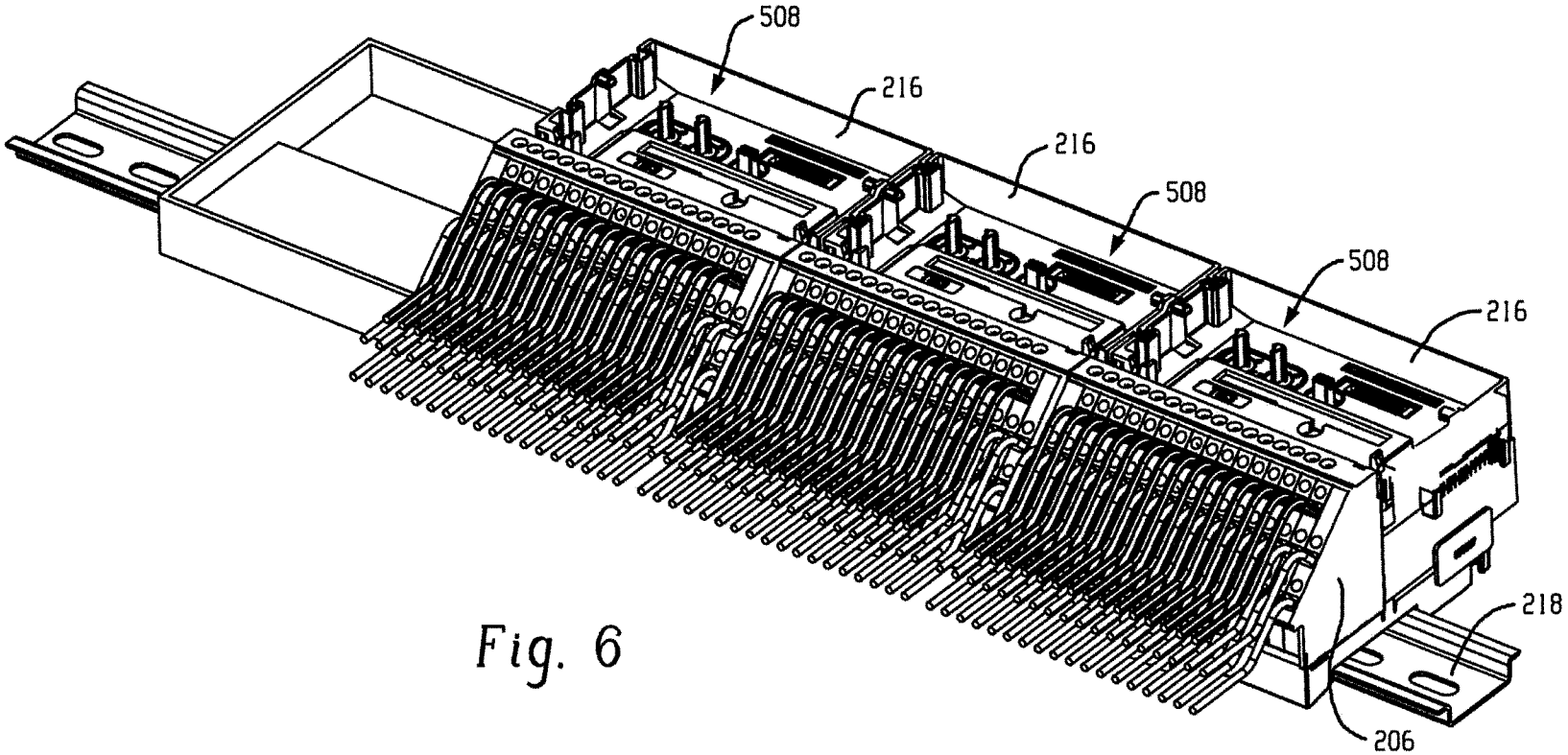
FIG. 6 is a perspective view of the installed migration adapters.

In FIGS. 5 and 6, I/O migration adapters 216 are installed onto each of the terminal bases 206. Release/retainer mechanisms R secure the I/O migration adapters 216 to the terminal bases 206. A communication module adapter 540 is secured to the DIN rail 218. The purpose of the communication module adaptor 540 will become apparent with reference to the remaining figures and description.

Figure 7B:
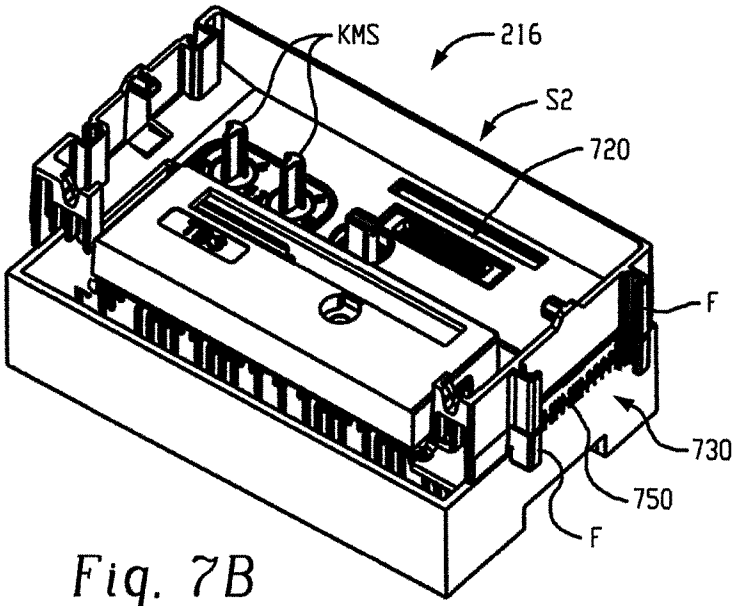
FIG. 7B is a perspective view of a second side of an exemplary migration adaptor in accordance with the present disclosure.
Figure 7A:
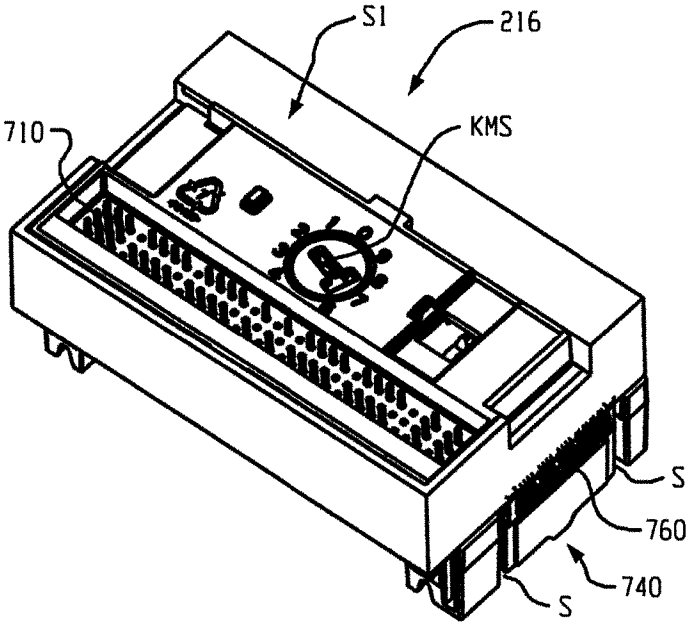
FIG. 7A is a perspective view of a first side of an exemplary migration adaptor in accordance with the present disclosure.

As will be appreciated, and with further reference to FIGS. 7A and 7B which illustrate first and second sides of an exemplary migration adapter 216, each I/O migration adapter 216 includes a first side S1 having one or more connectors 710 and other structure/mechanisms configured for electrically and mechanically coupling the I/O migration adapter 216 to the terminal base 206. In addition, each I/O migration adapter 216 includes a second side S2 having one or more connectors 720 and other structure/mechanisms configured for electrically and mechanically coupling the I/O migration adapter 216 to the second generation I/O module 214.

Opposite longitudinal ends of the I/O migration adapter 216 have first (e.g. male) and second (e.g., female) backplane connectors 730 and 740 for mating with respective backplane connectors on adjacent I/O migration adapters 216 and/or the communication module to define a second backplane or backplane circuit for transmission of electrical power and data to and between all of the migration adapters 216. The male backplane connector 730 includes flanges F having a general L-shape adapted to be received in correspondingly shaped slots S of a female backplane connector 740. The flanges F and slots S interlock to restrict separation of adjacent migration adapters to maintain contact between respective backplane connector conductor power and data structures 750 and 760.

Each I/O migration adapter 216 can further include keyed mechanical structures KMS for mating with corresponding keyed mechanical structures of the terminal base 206 and/or second generation I/O module 214 to mechanically prohibit or restrict certain second generation I/O modules 214 from being inserted into certain I/O migration adapters 216. An example of a mechanical keying arrangement is set forth in U.S. Pat. No. 9,362,685, which is hereby incorporated herein by reference in its entirety.

Turning to FIGS. 8 and 9, the second generation I/O modules 214 are installed onto the I/O migration adapters 216. As will be appreciated, each of the second generation I/O modules 214 includes connectors and other structure/mechanisms configured for electrically and mechanically coupling the I/O module to a migration adapter 216. Second generation communication module 212 is mounted to communication module adaptor 540. In the illustrated embodiment, the communication module adaptor 540 is used to align (e.g., in a common plane above the DIN rail 218) the female backplane connector 730 of the communication module 212 with the male backplane connector 740 of the first of the second generation I/O modules 214.

It will now be appreciated that the present disclosure sets forth a system and method for upgrading an I/O system without requiring removal or rewiring of major components. In the exemplary embodiments, neither the existing terminal bases or wired connections thereto need to be removed when performing the conversion from the first generation I/O system to the second generation I/O system 210. In many instances, an existing I/O system can be upgraded within hours using aspects of the present disclosure. In comparison, conventional system upgrades may require a full day or more to complete, during which time associated field devices are offline. Accordingly, aspects of the present disclosure can result in both time and expense savings.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An I/O system comprising:

a support structure;

a plurality of terminal bases mounted to the support structure, each terminal base including a terminal block for electrically coupling the terminal base to an associated field device, first and second backplane connectors for mating with corresponding backplane connectors of one or more adjacent terminal bases mounted on the support structure for forming a first backplane electrically coupling the plurality of terminal bases, and a receptacle having a first connector structure electrically coupled to the terminal block and the first and second backplane connectors;

a plurality of migration adapters, each migration adapter mounted to a respective terminal base and having first and second adapter connector structures, the first adapter connector structure configured for electrically and mechanically coupling the migration adapter with the first connector structure of the terminal base, the migration adapter further including first and second backplane connectors for mating with corresponding backplane connectors of one or more adjacent migration adapters mounted to respective adjacent terminal bases for forming a second backplane electrically coupling the plurality of migration adapters; and a plurality of I/O modules mounted to the plurality of migration adapters, each I/O module having an I/O module connector structure for electrically and mechanically coupling the I/O module to the second adapter connector structure of the migration adapter to which it is mounted;

wherein each of the I/O modules are electrically coupled to a respective associated field device via the respective migration adapter to which it is mounted and the terminal block of the terminal base to which the I/O is mounted, and electrically coupled to the second backplane.

2. The I/O system of claim 1, wherein the first and second backplane connectors of each of the plurality of migration adapters includes a female backplane connector and a male backplane connector, wherein a female backplane connector of a first migration adapter is configured to slidingly receive a male backplane connector of an adjacent second migration adapter.

3. The I/O system of claim 2, wherein the female backplane connector includes a pair of spaced apart slots adapted to receive respective flanges of a male backplane connector.

4. The I/O system of claim 3, wherein the flanges are L-shape in cross-section and interlock with surfaces of the slots to restrict separation of adjacent migration adapters.

5. The I/O system of claim 1, wherein the second backplane is spaced apart from the first backplane.

6. The I/O system of claim 5, wherein the second backplane is spaced further from the support structure than the first backplane.

7. The I/O system of claim 1, wherein the support includes a DIN rail.

8. The I/O system of claim 1, wherein the migration adapter includes at least one keyed mechanical structure for mating with a corresponding keyed mechanical structure of the I/O module.

9. An migration adapter for adapting a first generation I/O system having a terminal base with a first connector structure for coupling with a first generation I/O module to a second generation I/O system including a second generation I/O module, the migration adapter comprising:

a body having a first adapter connector structure, the first adapter connector structure configured for mechanically coupling the migration adapter with the first connector structure of an associated terminal base and electrically coupling the migration adapter to a terminal block of the associated terminal base, the migration adapter further including first and second backplane connectors for respectively mating with corresponding second and first backplane connectors of one or more adjacent associated migration adapters for forming a backplane electrically coupling the plurality of migration adapters, and a second adapter connector structure configured for mechanically and electrically coupling the migration adapter to an associated second generation I/O module such that the associated second generation I/O module is electrically coupled to the terminal block of the associated terminal base via the migration adapter and electrically coupled to the backplane formed by the plurality of migration adapters, whereby the associated second I/O module is electrically coupled to a field device connected to the associated terminal base.

10. The migration adapter of claim 9, wherein the first and second backplane connectors include respective male and female backplane connectors on opposite end faces of the body.

11. The migration adapter of claim 10, wherein the female backplane connector is configured to slidingly receive a male backplane connector of an adjacent migration adapter.

12. The migration adapter of claim 11, wherein the female backplane connector includes a pair of spaced apart slots adapted to receive respective flanges of the male backplane connector of an adjacent migration adapter.

13. The migration adapter of claim 12, wherein the flanges are L-shape in cross-section and interlock with surfaces of the slots to restrict separation of adjacent migration adapters.

14. The migration adapter of claim 9, further including at least one keyed mechanical structure for mating with a corresponding keyed mechanical structure of at least the second generation I/O module.

15. A method comprising:

removing a first generation I/O module from an existing I/O system installation, the existing I/O system installation having at least one terminal base mounted to a support, the at least one terminal base having a terminal block for coupling the terminal base with at least one field device;

installing a migration adapter to the terminal base in place of the first generation I/O module, the migration module including a body having a first adapter connector structure configured for mechanically coupling the migration adapter with the terminal base and electrically coupling the migration adapter to the terminal block of the associated terminal base, the migration adapter further including first and second backplane connectors for mating with corresponding backplane connectors of one or more adjacent associated migration adapters for forming a backplane electrically coupling the plurality of migration adapters, and a second adapter connector structure configured for mechanically and electrically coupling the migration adapter to a second generation I/O module;

installing a second generation I/O module to the migration adapter such that the second generation I/O module is electrically coupled to the terminal block of the associated terminal base via the migration adapter and electrically coupled to the backplane.

* * * * *